US005832748A

United States Patent [19]

Bonaquist

[11] Patent Number: 5,832,748

[45] Date of Patent: Nov. 10, 1998

[54] SINGLE COLUMN CRYOGENIC RECTIFICATION SYSTEM FOR LOWER PURITY OXYGEN PRODUCTION

[75] Inventor: Dante Patrick Bonaquist, Grand Island, N.Y.

[73] Assignee: Praxair Technology, Inc., Danbury, Conn.

[21] Appl. No.: 612,519

[22] Filed: Mar. 19, 1996

[51] Int. Cl.[6] ..... F25J 3/00

[52] U.S. Cl. ..... 62/647; 62/654; 62/901

[58] Field of Search ..... 62/647, 654, 901

[56] References Cited

U.S. PATENT DOCUMENTS

| | | | |
|---|---|---|---|
| 5,325,674 | 7/1994 | Gastinne et al. | 62/901 |
| 5,363,657 | 11/1994 | Naumovitz | 62/39 |
| 5,404,725 | 4/1995 | Arriulou | 62/646 |
| 5,442,925 | 8/1995 | Agrawal et al. | 62/24 |

*Primary Examiner*—Ronald C. Capossela
*Attorney, Agent, or Firm*—Stanley Ktorides

[57] ABSTRACT

A single column cryogenic rectification system for producing lower purity oxygen wherein a major portion of the feed air is partially condensed in the column reboiler, the resulting vapor turboexpanded and then successively condensed in one or more vertically oriented stages within the column to enhance the generation of upflow vapor and reflux liquid for the column.

11 Claims, 3 Drawing Sheets

SINGLE COLUMN CRYOGENIC RECTIFICATION SYSTEM FOR LOWER PURITY OXYGEN PRODUCTION

FIELD OF THE INVENTION

This invention relates generally to cryogenic rectification and more particularly to the production of lower purity oxygen.

BACKGROUND ART

The cryogenic rectification of air to produce oxygen and nitrogen is a well established industrial process. Typically the feed air is separated in a double column system wherein nitrogen shelf or top vapor from a higher pressure column is used to reboil oxygen bottom liquid in a lower pressure column.

The demand for lower purity oxygen is increasing in applications such as glassmaking, steelmaking and energy production. Less vapor boilup in the stripping sections of the lower pressure column, and less liquid reflux in the enriching sections of the lower pressure column are necessary for the production of lower purity oxygen which has an oxygen purity of 97 mole percent or less, than are typically generated by the operation of a double column.

Accordingly, lower purity oxygen is generally produced in large quantities by a cryogenic rectification system wherein feed air at the pressure of the higher pressure column is used to reboil the liquid bottoms of the lower pressure column and is then passed into the higher pressure column. The use of air instead of nitrogen to vaporize the lower pressure column bottoms reduces the air feed pressure requirements, and enables the generation of only the necessary boil-up in the stripping sections of the lower pressure column either by feeding the appropriate portion of the air to the lower pressure column reboiler or by partially condensing a larger portion of the total feed air.

While the conventional air boiling cryogenic rectification system has been used effectively for the production of lower purity oxygen, its ability to generate reflux for supply to the top of the lower pressure column is limited. This results from the fact that condensation of some of the feed air reduces the available vapor for generation of nitrogen reflux in the higher pressure column. More power is consumed because oxygen recovery is reduced as a result of the reduced capability to generate reflux. Moreover, double column systems have a high capital cost associated with them.

Accordingly, it is an object of this invention to provide a cryogenic rectification system for producing lower purity oxygen which operates with reduced power requirements and has reduced capital costs compared with conventional systems.

SUMMARY OF THE INVENTION

The above and other objects which will become apparent to one skilled in the art upon a reading of the disclosure are attained by the present invention one aspect of which is:

A method for producing lower purity oxygen by the cryogenic rectification of feed air comprising:

(A) partially condensing a major portion of the feed air to produce a first liquid air portion and a first vapor air portion;

(B) turboexpanding the first vapor air portion and partially condensing the turboexpanded first vapor air portion by indirect heat exchange with fluid within a column to produce a second liquid air portion and a second vapor air portion;

(C) at least partially condensing the second vapor air portion by indirect heat exchange with fluid within the column above where the heat exchange of step (C) is carried out to produce a third liquid air portion;

(D) passing the first liquid air portion into the column, passing the second liquid air portion into the column above where the first liquid air portion is passed into the column, and passing the third liquid air portion into the column above where the second liquid air portion is passed into the column;

(E) separating the fluids passed into the column by cryogenic rectification into nitrogen-enriched fluid and oxygen-enriched fluid; and (F) recovering oxygen-enriched fluid as product lower purity oxygen.

Another aspect of the invention is:

Apparatus for producing lower purity oxygen comprising:

(A) a column having a bottom reboiler, and means for passing feed air to the bottom reboiler;

(B) a turboexpander and means for passing vapor from the bottom reboiler to the turboexpander;

(C) a first heat exchanger within the column, and means for passing vapor from the turboexpander into the first heat exchanger;

(D) a second heat exchanger within the column above the first heat exchanger and means for passing vapor from the first heat exchanger into the second heat exchanger;

(E) means for passing liquid from the bottom reboiler into the column, means for passing liquid from the first heat exchanger into the column above where liquid from the bottom reboiler is passed into the column, and means for passing liquid from the second heat exchanger into the column above where liquid from the first heat exchanger is passed into the column; and (F) means for recovering product lower purity oxygen from the column.

A further aspect of this invention is:

A method for producing lower purity oxygen by the cryogenic rectification of feed air comprising:

(A) partially condensing a major portion of the feed air to produce a first liquid air portion and a first vapor air portion;

(B) turboexpanding the first vapor air portion and at least partially condensing the turboexpanded first vapor air portion by indirect heat exchange with fluid within a column to produce a second liquid air portion;

(C) passing the first liquid air portion into the column and passing the second liquid air portion into the column above where the first liquid air portion is passed into the column;

(D) separating the fluids passed into the column by cryogenic rectification into nitrogen-enriched fluid and oxygen-enriched fluid; and (E) recovering oxygen-enriched fluid as product lower purity oxygen.

Yet another aspect of the invention is:

Apparatus for producing lower purity oxygen comprising:

(A) a column having a bottom reboiler, and means for passing feed air to the bottom reboiler;

(B) a turboexpander and means for passing vapor from the bottom reboiler to the turboexpander;

(C) a heat exchanger within the column, and means for passing vapor from the turboexpander into the heat exchanger;

(D) means for passing liquid from the bottom reboiler into the column and means for passing liquid from the heat exchanger into the column above where liquid from the bottom reboiler is passed into the column; and (E) means for recovering product lower purity oxygen from the column.

As used herein the term "bottom reboiler" means a heat exchange device which generates column upflow vapor from column bottom liquid. The bottom reboiler may be physically within, or it may be outside, the column.

As used herein, the term "lower purity oxygen" means a fluid having an oxygen concentration of 97 mole percent or less.

As used herein, the term "feed air" means a mixture comprising primarily nitrogen and oxygen, such as ambient air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation of fractionation column or zone, i.e. a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineer's Handbook fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phase is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin.

As used herein, the term "indirect heat exchange" means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the term "within a column" when referring to heat exchange means functionally within that column, i.e. physically within that column or adjacent that column with liquid from that column passed to the heat exchange device. The liquid may be totally or partially vaporized and the resultant gas or gas-liquid mixture is returned to the column. Preferably the liquid is partially vaporized and the resultant gas-liquid mixture is returned to the column at the same level as the liquid is withdrawn from the column.

DETAILED DESCRIPTION OF THE INVENTION

The invention is a single column system with one or more intermediate level reboilers. The reboilers, i.e. heat exchangers which vaporize column downflow liquid, condense feed air in a staged fashion to provide added boilup and reflux for the column thereby improving the product oxygen recovery. The intermediate heat exchangers take advantage of the excess driving force available in the stripping section of the column thereby reducing much of the thermodynamic inevsibilities present in the column. By partially condensing a lower pressure feed air stream in an intermediate heat exchanger in the column against partially reboiling column liquid, the operating line of this section of the column is brought closer to the equilibrium line thus reducing the energy requirements of the system. In a particularly preferred embodiment, phase separation of the partially condensed lower pressure feed air provides the opportunity for the incorporation of a second intermediate heat exchanger at a higher level in the column. In this second intermediate heat exchanger the separated vapor from the first intermediate heat exchanger is preferably totally condensed against partially reboiling column liquid. The liquid leaving the intermediate heat exchanger does not mix with the entering liquid on the vaporizing side. The liquids produced in each stage of intermediate heat exchange are transferred to the proper levels in the column thus supplementing the normally available reflux.

Figure 1:
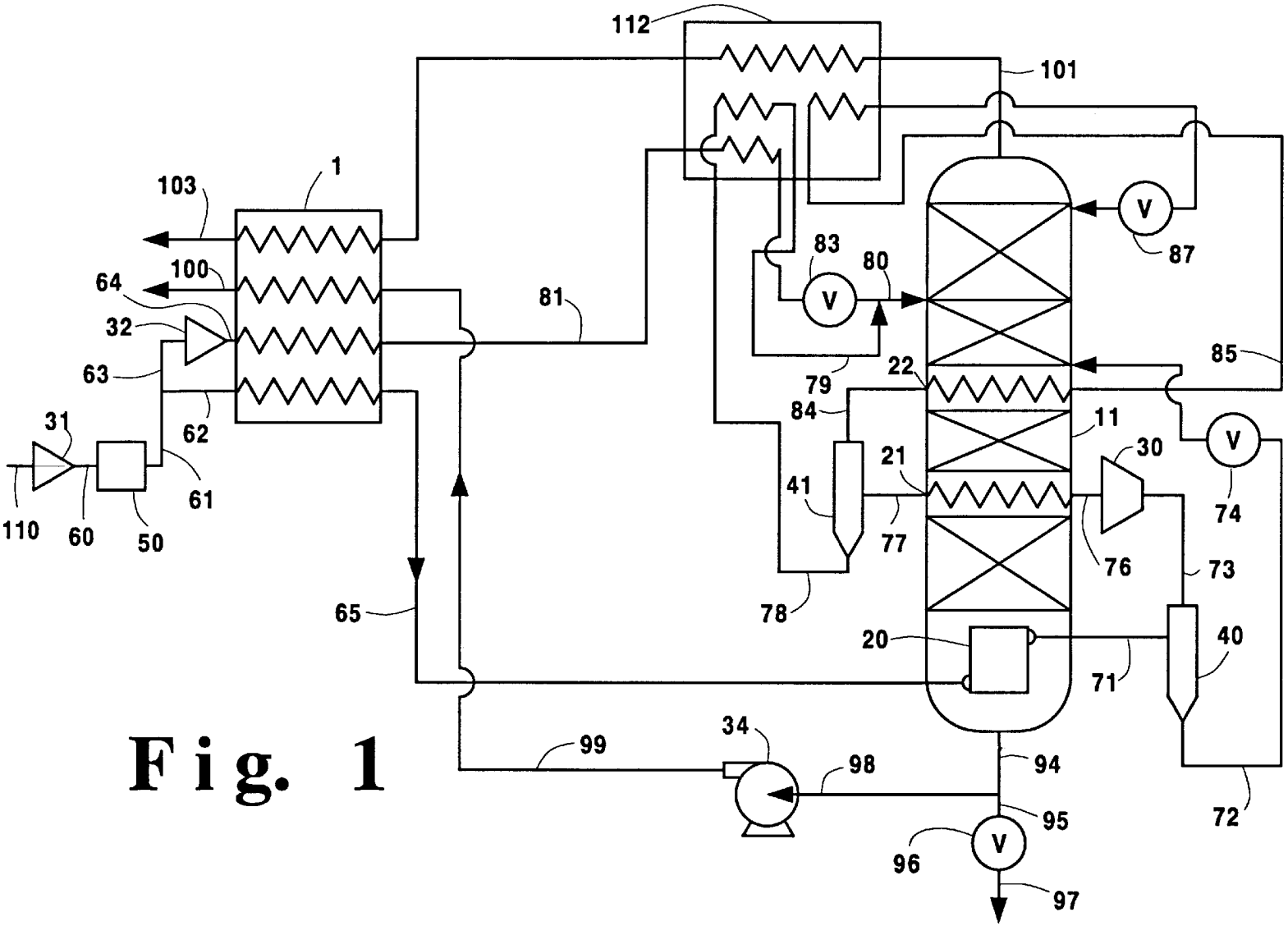
FIG. 1 is a schematic flow diagram of one particularly preferred embodiment of the single column cryogenic rectification system of the invention.

The invention will be described in greater detail with reference to the Drawings. Referring now to FIG. 1, feed air 110 is compressed to a pressure generally within the range of from 30 to 100 pounds per square inch absolute (psia) by passage through base load compressor 31 and resulting feed air stream 60 is cleaned of high boiling impurities such as water vapor and carbon dioxide by passage through purifier 50. Resulting feed air stream 61 is divided into major portion 62 and minor portion 63. Minor portion 63, which comprises from 15 to 40 percent of feed air, is increased in pressure by passage through booster compressor 32 to a pressure within the range of from 50 to 1200 psia, and resulting stream 64 is cooled, and preferably partially condensed, by indirect heat exchange with return streams in main heat exchanger 1. Resulting stream 81 is further cooled by partial traverse through heat exchanger 112 and then passed through valve 83 and into column 11. In the embodiment illustrated in FIG. 1, stream 81 is combined with liquid from the first intermediate heat exchanger, as will be more fully described later, to form combined stream 80 which is passed into column 11.

Major feed air portion 62, which comprises from 60 to 85 percent of feed air 110, is cooled by indirect heat exchange against return streams in main heat exchanger 1. Cooled major feed air portion 65 is passed to bottom reboiler 20 wherein it is partially condensed by indirect heat exchange with boiling column 11 bottom liquid. Resulting two phase stream 71 is passed to phase separator 40 and separated into first liquid air portion 72, which has an oxygen concentration exceeding that of stream 65, and first vapor air portion 73, which has a nitrogen concentration exceeding that of stream 65.

First vapor air portion 73 is passed to turboexpander 30 wherein it is turboexpanded to a pressure within the range of from 20 to 50 psia and resulting turboexpanded stream 76 is passed through first intermediate heat exchanger 21 which is located within column 11 from 1 to 10 equilibrium stages above bottom reboiler 20. Preferably first vapor air portion 73 is superheated prior to the turboexpansion in turboexpander 30. Within first intermediate heat exchanger 21 turboexpanded first vapor air portion 76 is partially condensed by indirect heat exchange with vaporizing, preferably partially vaporizing, liquid flowing down column 11 thereby generating upflow vapor for column 11 and producing a second liquid air portion and a second vapor air portion which are passed as two phase stream 77 from first intermediate heat exchanger 21 into phase separator 41.

Second vapor air portion 84, which has a nitrogen concentration exceeding that of stream 76, is passed out from phase separator 41 into second intermediate heat exchanger 22 which is located within column 11 above, generally about 1 to 25 equilibrium stages above, first intermediate heat exchanger 21. Within second intermediate heat exchanger 22, first vapor air portion 84 is at least partially and preferably is totally condensed by indirect heat exchange with vaporizing, preferably partially vaporizing, liquid flowing down column 11 thereby generating additional upflow vapor for column 11 and producing a third liquid air portion.

First liquid air portion 72 is passed out from phase separator 40, through valve 74 and into column 11 at a point at or above, generally up to 10 equilibrium stages above, second intermediate heat exchanger 22. Second liquid air portion 78, which has an oxygen concentration exceeding that of stream 76, is passed out from phase separator 41, subcooled by partial traverse through heat exchanger 112 against stream 101 to form subcooled stream 79, and passed into column 11 at a point above, generally from 1 to 15 equilibrium stages above, the point where first liquid air portion 72 is passed into column 11. As mentioned previously, in the embodiment illustrated in FIG. 1, stream 79 is combined with stream 81 to form combined stream 80 which is passed into column 11 as previously described.

The third liquid air portion is withdrawn from second intermediate heat exchanger 22 as stream 85, subcooled by partial traverse through heat exchanger 112 against stream 101, and passed through valve 87 into column 11 at a point above, generally from 1 to 15 equilibrium stages above, the point where the second liquid air portion is passed into column 11.

Column 11 operates at a pressure within the range of from 15 to 35 psia. Within column 11 the various feeds are separated by cryogenic rectification into nitrogen-enriched fluid and oxygen-enriched fluid. Nitrogen-enriched fluid is withdrawn as vapor stream 101 from column 11, warmed by passage through heat exchangers 112 and 1 and passed out of the system as nitrogen stream 103 which may be recovered in whole or in part as nitrogen product having a nitrogen concentration within the range of from 90 to 98 mole percent.

Oxygen-enriched fluid is recovered from column 11 as lower purity oxygen product. The lower purity oxygen product may be recovered as vapor, elevated pressure vapor and/or liquid. For example, oxygen-enriched fluid may be withdrawn as a vapor from column 11 at a point above bottom reboiler 20 and recovered as product lower purity oxygen gas. FIG. 1 illustrates an embodiment wherein the lower purity oxygen is recovered as pressurized lower purity oxygen gas. Referring back to FIG. 1, oxygen-enriched fluid is withdrawn from column 11 as liquid stream 94. If desired a portion 95 of stream 94 may be passed through valve 96 and recovered as product lower purity liquid oxygen 97. Remaining liquid stream 98, which may comprise all or a portion of stream 94, is pumped to a pressure within the range of from 20 to 1200 psia by passage through liquid pump 34 and resulting pressurized stream 99 is vaporized by passage through main heat exchanger 1 by indirect heat exchange with the aforesaid cooling feed air. Resulting stream 100 is recovered as elevated pressure lower purity oxygen gas product.

Figure 2:
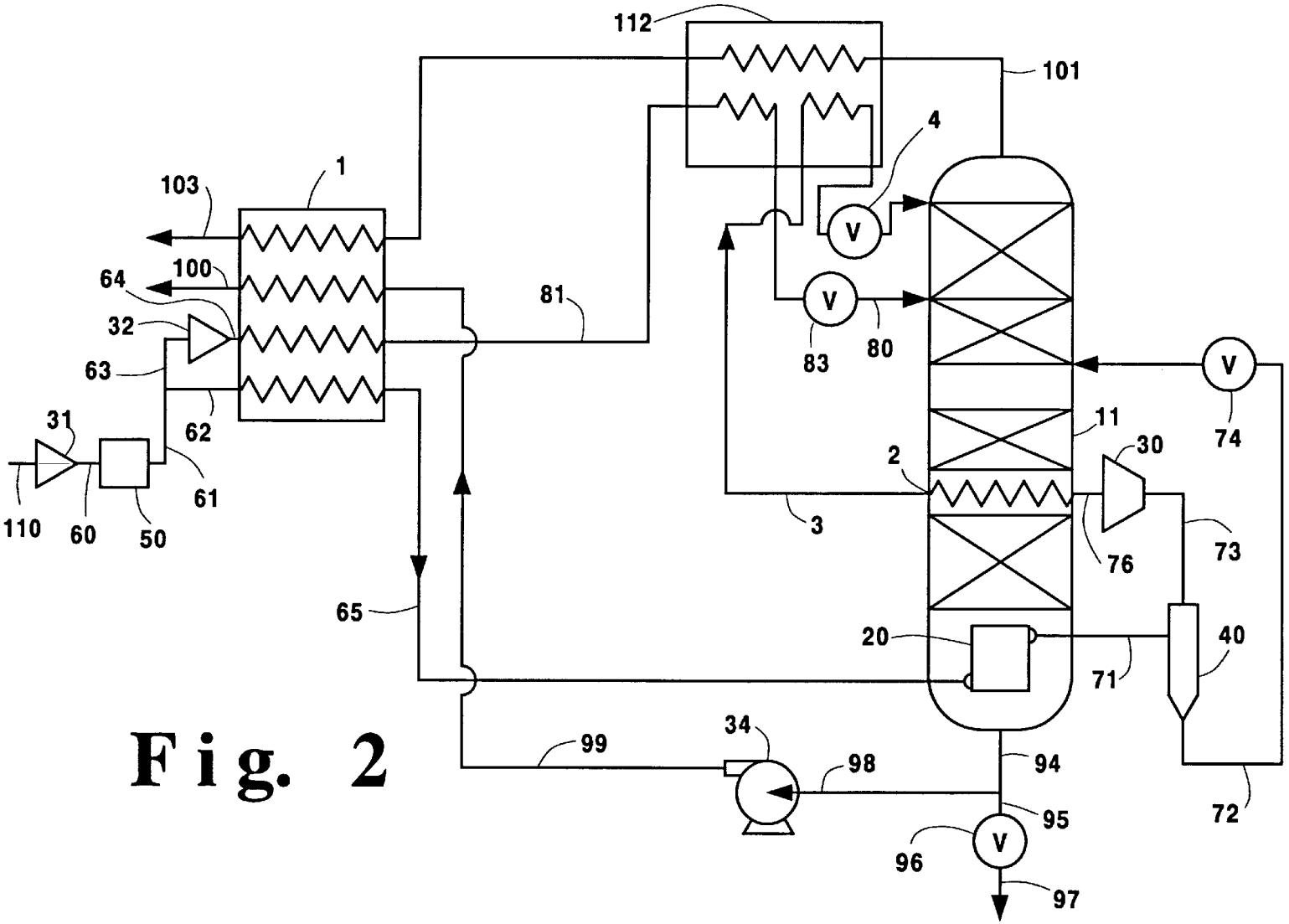
FIG. 2 is a schematic flow diagram of another preferred embodiment of the single column cryogenic rectification system of the invention.

FIG. 2 illustrates another embodiment of the invention wherein one intermediate level heat exchanger is employed. The numerals in FIG. 2 correspond to those of FIG. 1 for the common elements and these common elements will not be described again in detail.

Referring now to FIG. 2, turboexpanded first vapor air portion 76 is passed into intermediate heat exchanger 2 which is located within column 11 above, generally about 1 to 20 equilibrium stages above, bottom reboiler 20. Within intermediate heat exchanger 2 first vapor air portion 76 is at least partially and preferably is totally condensed by indirect heat exchange with vaporizing, preferably partially vaporizing, liquid flowing down column 11 thereby generating additional upflow vapor for column 11 and producing a second liquid air portion. First liquid air portion 72 is passed out from phase separator 40, through valve 74 and into column 11 at a point above, generally from 1 to 15 equilibrium stages above, intermediate heat exchanger 2. Second liquid air portion 3 is passed out from intermediate heat exchanger 2, partially through heat exchanger 112 where it is cooled against stream 101, through valve 4, and into column 11 at a point above, generally from 1 to 15 equilibrium stages above, the point where first liquid air portion 72 is passed into column 11.

Figure 3:
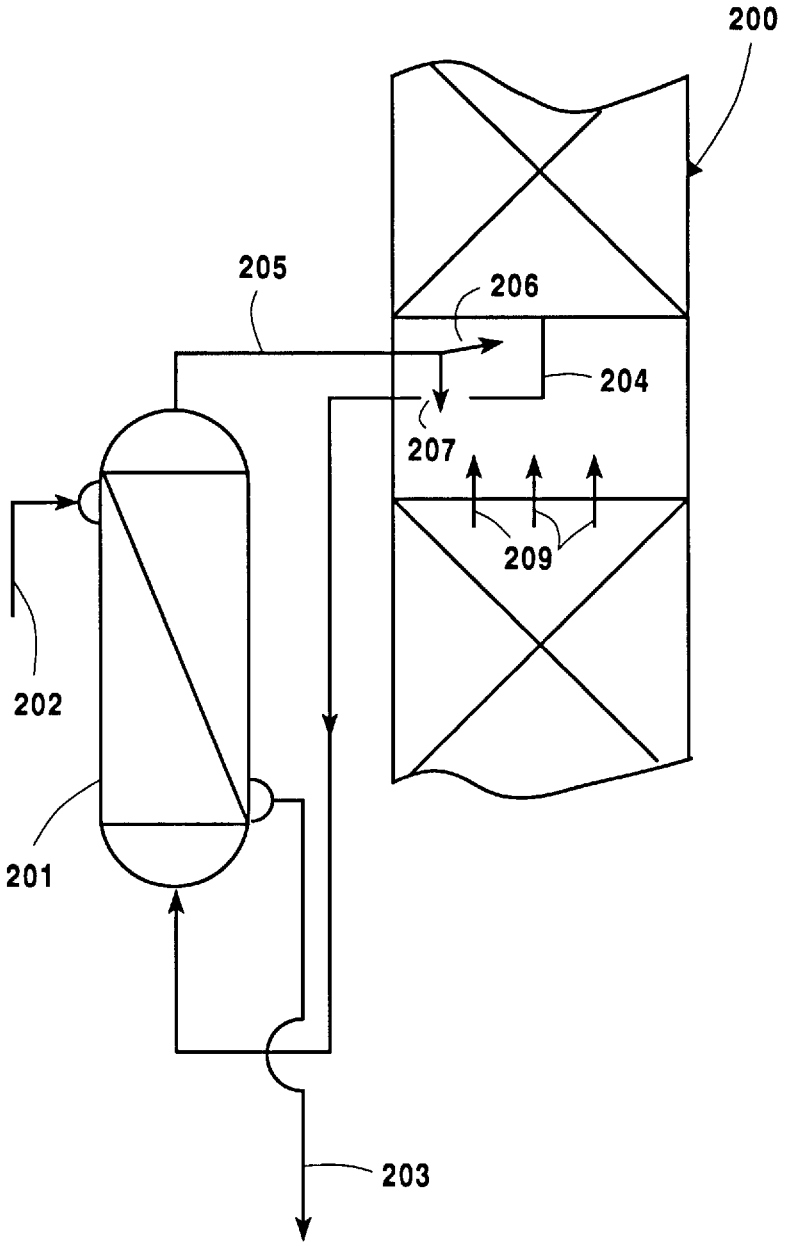
FIG. 3 is a representation of a preferred heat exchange arrangement in the practice of the invention wherein the defined heat exchange within a column takes place outside the column shell.

While FIGS. 1 and 2 illustrate the heat exchange associated with heat exchangers 21 and 2 as occurring physically within the shell of the column, this is done to simplify the illustration of the method of the invention. In many instances it is expected that one or more such heat exchangers will be located physically outside the shell of the column, i.e. functionally within the column. FIG. 3 illustrates one arrangement in generalized form of such a heat exchanger functionally within the column.

Referring now to FIG. 3, liquid descending within column 200 is collected and withdrawn from the column as stream

204. Means for collection and withdrawal of the liquid are well known to those knowledgeable in the design of distillation equipment. Liquid stream 204 is introduced to heat exchanger 201 which may be a brazed aluminum heat exchanger. As liquid 204 traverses heat exchanger 201, it is at least partially vaporized by indirect heat exchange with a fluid 202 which is at least partially condensed. Fluid 202 represents the vapor flow into the heat exchanger, e.g. stream 76 or stream 84 of FIG. 1. Streams 202 and 204 flow in a counter-current fashion within heat exchanger 201. Partially vaporized liquid 205 exits heat exchanger 201 and is delivered back to column 200. Preferably the partially vaporized liquid is returned to the column in such a fashion that the vapor portion 206 is able to mix with vapor 209 rising within the column from below the point where liquid 204 was originally withdrawn. The means for accomplishing this are commonly employed in distillation column design when a two-phase stream is introduced to an intermediate location within the column. The liquid portion 207 of stream 205 is disengaged from the vapor portion and is preferably distributed to those mass transfer elements such as packing or trays immediately below the level from where liquid 204 was originally withdrawn. The means for disengaging the liquid from the vapor and for distributing the liquid as described are commonly employed in distillation column design. Although from a functional viewpoint it is preferred to employ all of the column downflowing liquid for stream 204, some design circumstances may dictate using only a portion of the downflowing liquid for this purpose. As mentioned, stream 202 is at least partially condensed by the heat exchange within heat exchanger 201. Resulting fluid in stream 203 is returned to the column. Stream 203 corresponds, for example, to stream 77 or stream 85 of FIG. 1.

Although the invention has been described in detail with reference to certain preferred embodiments, those skilled in the art will recognize that there are other embodiments of the invention within the spirit and the scope of the claims.

I claim:

1. A method for producing lower purity oxygen by the cryogenic rectification of feed air comprising:

(A) partially condensing a major portion of the feed air to produce a first liquid air portion and a first vapor air portion;

(B) turboexpanding the first vapor air portion and partially condensing the turboexpanded first vapor air portion by indirect heat exchange with fluid within a column to produce a second liquid air portion and a second vapor air portion;

(C) at least partially condensing the second vapor air portion by indirect heat exchange with fluid within the column above where the heat exchange of step (C) is carried out to produce a third liquid air portion;

(D) passing the first liquid air portion into the column, passing the second liquid air portion into the column above where the first liquid air portion is passed into the column, and passing the third liquid air portion into the column above where the second liquid air portion is passed into the column;

(E) separating the fluids passed into the column by cryogenic rectification into nitrogen-enriched fluid and oxygen-enriched fluid; and (F) recovering oxygen-enriched fluid as product lower purity oxygen.

2. The method of claim 1 wherein product lower purity oxygen is recovered as gas.

3. The method of claim 2 wherein oxygen-enriched fluid is withdrawn from the column as liquid, pumped to a higher pressure and vaporized by indirect heat exchange with feed air prior to recovery.

4. The method of claim 1 wherein product lower purity oxygen is recovered as liquid.

5. The method of claim 1 further comprising recovering nitrogen-enriched fluid as product nitrogen.

6. The method of claim 1 further comprising pressurizing a minor portion of the feed air, at least partially condensing the pressurized minor portion by indirect heat exchange with oxygen-enriched fluid, and thereafter passing the resulting feed air into the column.

7. Apparatus for producing lower purity oxygen comprising:

(A) a column having a bottom reboiler, and means for passing feed air to the bottom reboiler;

(B) a turboexpander and means for passing vapor from the bottom reboiler to the turboexpander;

(C) a first heat exchanger within the column, and means for passing vapor from the turboexpander into the first heat exchanger;

(D) a second heat exchanger within the column above the first heat exchanger, and means for passing vapor from the first heat exchanger into the second heat exchanger;

(E) means for passing liquid from the bottom reboiler into the column, means for passing liquid from the first heat exchanger into the column above where liquid from the bottom reboiler is passed into the column, and means for passing liquid from the second heat exchanger into the column above where liquid from the first heat exchanger is passed into the column; and (F) means for recovering product lower purity oxygen from the column.

8. The apparatus of claim 7 wherein the means for recovering product lower purity oxygen includes a liquid pump.

9. The apparatus of claim 7 further comprising means for recovering product nitrogen from the column.

10. A method for producing lower purity oxygen by the cryogenic rectification of feed air comprising:

(A) partially condensing a major portion of the feed air to produce a first liquid air portion and a first vapor air portion;

(B) turboexpanding the first vapor air portion and at least partially condensing the turboexpanded first vapor air portion by indirect heat exchange with fluid within a column to produce a second liquid air portion;

(C) passing the first liquid air portion into the column and passing the second liquid air portion into the column above where the first liquid air portion is passed into the column;

(D) separating the fluids passed into the column by cryogenic rectification into nitrogen-enriched fluid and oxygen-enriched fluid; and (E) recovering oxygen-enriched fluid as product lower purity oxygen.

11. Apparatus for producing lower purity oxygen comprising:

(A) a column having a bottom reboiler, and means for passing feed air to the bottom reboiler;

(B) a turboexpander and means for passing vapor from the bottom reboiler to the turboexpander;

(C) a heat exchanger within the column, and means for passing vapor from the turboexpander into the heat exchanger;

(D) means for passing liquid from the bottom reboiler into the column and means for passing liquid from the heat exchanger into the column above where liquid from the bottom reboiler is passed into the column; and (E) means for recovering product lower purity oxygen from the column.

* * * * *